United States Patent [19]

Howe et al.

[11] Patent Number: 4,733,272

[45] Date of Patent: Mar. 22, 1988

[54] FILTER REGENERATION IN AN ELECTROPHOTOGRAPHIC PRINTING MACHINE

[75] Inventors: William C. Howe; Dexter A. Dyer, both of Walworth, N.Y.

[73] Assignee: Xerox Corporation, Stamford, Conn.

[21] Appl. No.: 886,503

[22] Filed: Jul. 17, 1986

[51] Int. Cl.[4] ..... G03G 15/10; G03G 15/20

[52] U.S. Cl. ..... 355/10; 219/216; 355/3 FU; 432/60

[58] Field of Search ..... 355/3 R, 10, 3 FU; 354/300; 432/60; 219/216

[56] References Cited

U.S. PATENT DOCUMENTS

| | | | |
|---|---|---|---|
| 1,863,803 | 1/1932 | Pantenburg . | |
| 2,944,404 | 7/1960 | Fritts | 62/3 |
| 3,635,555 | 1/1972 | Kurahashi et al. | 355/8 |
| 3,720,150 | 3/1973 | Hurtig et al. | 354/300 X |
| 3,767,300 | 10/1973 | Brown et al. | 355/15 |
| 3,854,224 | 12/1974 | Uamaji et al. | 34/77 |
| 3,880,515 | 4/1975 | Tanaka et al. | 355/10 |
| 3,889,390 | 6/1975 | Klare | 34/23 |
| 3,890,721 | 6/1975 | Katayama et al. | 34/73 |
| 3,926,519 | 12/1975 | Rebres | 355/14 |
| 3,997,977 | 12/1976 | Katayama et al. | 34/73 |
| 4,166,728 | 9/1979 | Degenhardt et al. | 354/300 X |
| 4,318,612 | 3/1982 | Brannan et al. | 355/14 |
| 4,462,675 | 7/1984 | Moraw et al. | 355/3 R |
| 4,567,349 | 1/1986 | Henry et al. | 219/216 |

*Primary Examiner*—Fred L. Braun

*Attorney, Agent, or Firm*—H. Fleischer; J. E. Beck; R. Zibelli

[57] ABSTRACT

A reproducing machine in which a liquid image including a liquid carrier having pigmented particles dispersed therein is transferred to a sheet of support material. In the operative mode, when the sheet of support material having the liquid image thereon is present, a fuser applies heat thereto to remove liquid carrier therefrom so as to dry the sheet of support material, and fuse the pigmented particles thereto in image configuration. In the standby mode, when the sheet of support material is not present, the fuser still generates heat. The liquid carrier removed from the sheet of support material by the fuser is collected in a condenser. Air flowing from the condenser passes through a filter to remove residual liquid carrier therefrom, in the standby mode, heated air from the fuser is directed to the filter to regenerate the filter.

12 Claims, 2 Drawing Figures

FILTER REGENERATION IN AN ELECTROPHOTOGRAPHIC PRINTING MACHINE

Figure 1:
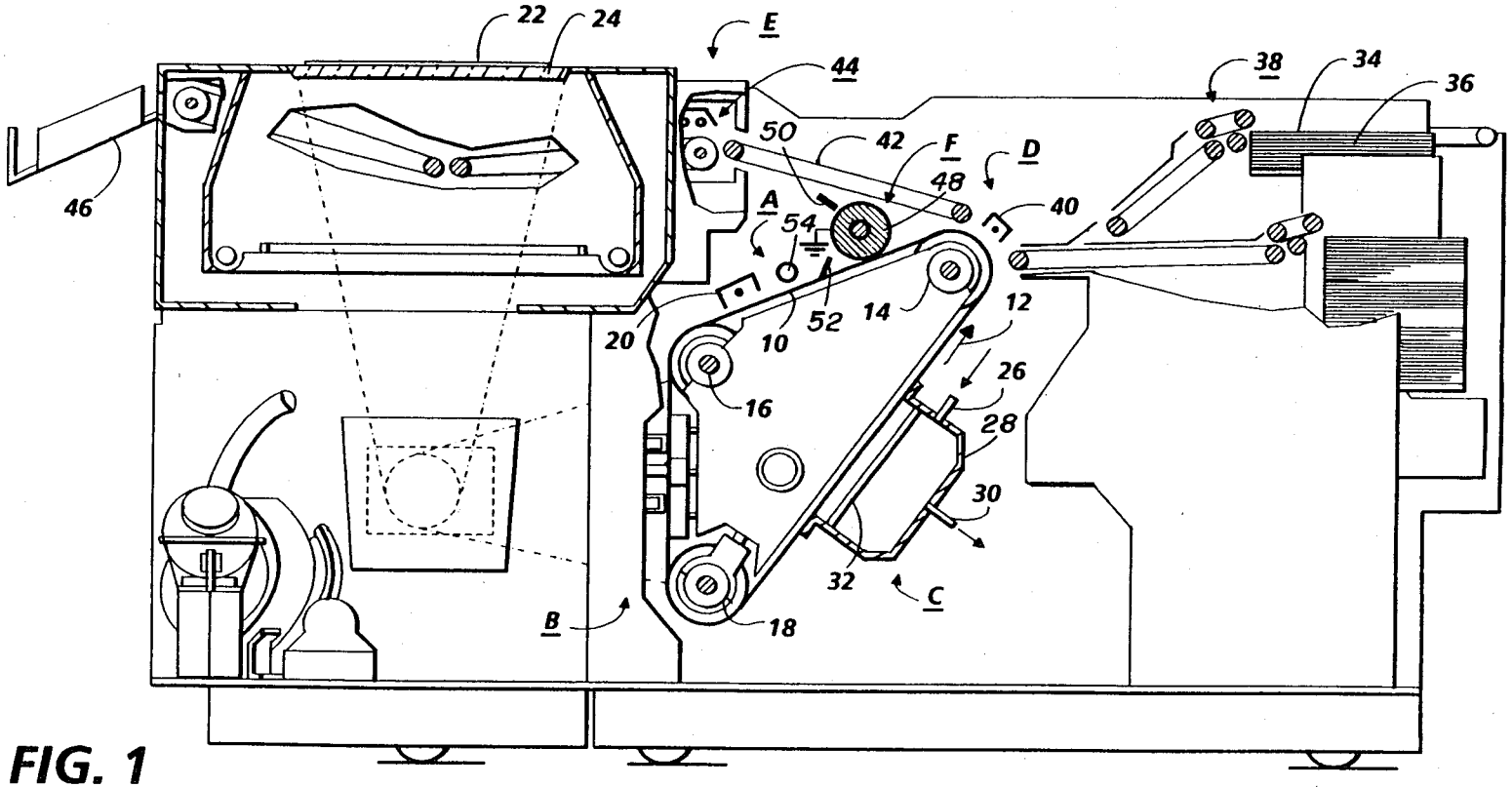

This invention relates to an electrophotographic printing machine, and more particularly concerns regeneration of a filter used to remove vaporized liquid carrier from the air exiting the printing machine and minimizing fuser power requirements.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles dispersed therein. The pigmented particles, i.e. toner particles, are deposited, in image configuration, on the photoconductive member. Thereafter, the developed image is transferred to the copy sheet. The developed image transferred to the copy sheet comprises both liquid carrier and toner particles. After transfer, heat is applied to the copy sheet to permanently fuse the pigmented particles and vaporize the liquid carrier adhering thereto. In order to maintain operator safety, it is necessary to eliminate or reclaim this vaporized liquid carrier. Furthermore, it is economically beneficial to reuse the reclaimed liquid carrier. It is also necessary to filter the air exiting from the electrophotographic printing machine in order to further minimize the escape of vaporized liquid carrier into the atmosphere. This minimizes room odor and eliminates safety hazards. However, filters must be periodically replaced, and in a high speed liquid electrophotographic printing machine, the cost of replacing filters after relatively short time lapses, is expensive. Furthermore, the amount of heat being generated by the fusing apparatus should be minimized in order to reduce the power requirements of the printing machine. Thus, it is advantageous to be capable of recovering vaporized liquid carrier, minimizing fuser power requirements, and preventing escape of vaporized liquid carrier from the printing machine into the atmosphere. A system capable of achieving the foregoing significantly improves the economics and environmental capabilities of liquid electrophotographic printing machines. The following disclosures appear to be relevant:

U.S. Pat. No. 1,863,803
Patentee: Pantenburg
Issued: June 21, 1932
U.S. Pat. No. 2,944,404
Patentee: Fritts
Issued: July 12, 1960
U.S. Pat. No. 3,635,555
Patentee: Kurahashi et al.
Issued: Jan. 18, 1972
U.S. Pat. No. 3,767,300
Patentee: Brown et al.
Issued: Oct. 23, 1973
U.S. Pat. No. 3,880,515
Patentee: Tanaka et al.

Issued: Apr. 29, 1975
U.S. Pat. No. 3,889,390
Patentee: Klare
Issued: June 17, 1975
U.S. Pat. No. 3,854,224
Patentee: Yamaji et al.
Issued: Dec. 17, 1974
U.S. Pat. No. 3,890,721
Patentee: Katayama et al.
Issued: June 4, 1975
U.S. Pat. No. 3,926,519
Patentee: Rebres
Issued: Dec. 16, 1975
U.S. Pat. No. 3,997,977
Patentee: Katayama et al.
Issued: Dec. 21, 1976
U.S. Pat. No. 4,318,612
Patentee: Brannan et al.
Issued: Mar. 9, 1982
U.S. Pat. No. 4,462,675
Patentee: Moraw et al.
Issued: July 31, 1984
U.S. Pat. No. 4,567,349
Patentee: Henry et al.
Issued: Jan. 28, 1986

The relevant portions of the foregoing patents may be briefly summarized as follows:

Patenburg discloses the basic process of regeneration of adsorption materials, such as activated carbon, by heating the material. A scavenging gas provides for the more uniform treatment in the removal of the adsorbed substances.

Fritts describes a heat pump condensing apparatus using a Peltier thermoelectric cooling device.

Kurahashi et al. discloses an air cooling device for recovering or removing developer solution vapors contained in the air in a copying machine. The vapors are drawn into a collection chamber and cooled by a cooling tube. The vapors condense on the cooling tube and are subsequently collected.

Brown et al. describes a process for cleaning fumes being exhausted from a duplicating machine. The carrier liquid and water vapors are condensed and separated. The carrier fluid is recirculated. The cooling system uses a liquid refrigerant to form a cold trap.

Tanaka et al. discloses cooling a carrier vapor to a mist by using cooling fans and liquefying the mist by corona charging of screen-like metal nets of electrically conductive wires or of electrically conductive plates.

Yamaji et al. discloses a liquid carrier which is recovered by cooling carrier vapor to a mist, followed by liquefication by corona charging, and the collection of the liquid formed.

Klare discloses a process in which a softening agent is continuously and automatically reclaimed from an exhaust air stream. This process, involved in the treatment of regenerated cellulose film, introduces an aqueous solution of the softening agent, followed by exposure to the air stream which captures excess water and softening agent. The air stream is then treated by a mist eliminator which prevents any contaminants from re-entering the liquid reservoir of the absorption section.

Katayama et al. ('721) describes a developing recovering device employing an orthogonal flow-type heat exchanger to convert the liquid vapor into a mist and subsequently to convert the mist to liquid by corona discharging.

Rebres describes a fuser having at least two temperature set points. A temperature controller activates a radiant energy source or an auxiliary source independently or simultaneously depending upon the operating temperature of the fuser.

Katayama et al. ('977) discloses a developing liquid recovery device using an orthogonal flow-type heat exchanger as a condenser to form a liquid vapor mist and a corona discharger for collecting the mist.

Brannan et al. discloses a control system providing more than one operating mode for a fuser. The control system regulates the fuser temperature set point or command temperature, depending upon the temperature of the fuser during a prior cycle.

Moraw et al. describes a process for recovering developer liquid vapors by condensing the vapors in a coil.

Henry et al. discloses a fuser roll maintained at fusing temperature during a running mode and having a heating element to maintain the roll at a predetermined standby temperature.

In accordance with one aspect of the present invention, there is provided a reproducing machine of the type having a liquid image comprising at least a liquid carrier having pigmented particles dispersed therein transferred to a sheet of support material. Means, in the operative mode, apply heat to the sheet of support material having the liquid image thereon to remove liquid carrier transferred thereto so as to dry the sheet of support material and fuse the pigmented particles transferred thereto in image configuration. In the standby mode, the heat applying means does not apply to the sheet of support material and generates heat. Means are provided for collecting the liquid carrier removed from the sheet of support material by the heat applying means. Means filter the air flowing from the collecting means to remove residual liquid carrier therefrom. In the standby mode, means are provided for directing heated air from the heat applying means to the filtering means to regenerate the filtering emans.

Pursuant to another aspect of the features of the present invention, there is provided an electrophotographic printing machine of the type having an electrostatic latent image recorded on a photoconductive member developed with a liquid developer material comprising at least a liquid carrier having pigmented particles dispersed therein to form a liquid image thereon and is transferred to a sheet of support material. Means, in the operative mode, apply heat to the sheet of support material having the liquid image thereon to remove liquid carrier transferred thereto so as to dry the sheet of support material and fuse the pigmented particles transferred thereto in image configuration. In the standby mode, the heat applying means does not apply heat to the sheet of support material and generates heat therefrom. Means are provided for collecting the liquid carrier removed from the sheet of support material by the heat applying means. Means filter the air flowing from the collecting means to remove residual liquid carrier therefrom. In the standby mode, means direct heated air from the heat applying means to the filter means to regenerate the filter means.

Figure 2:
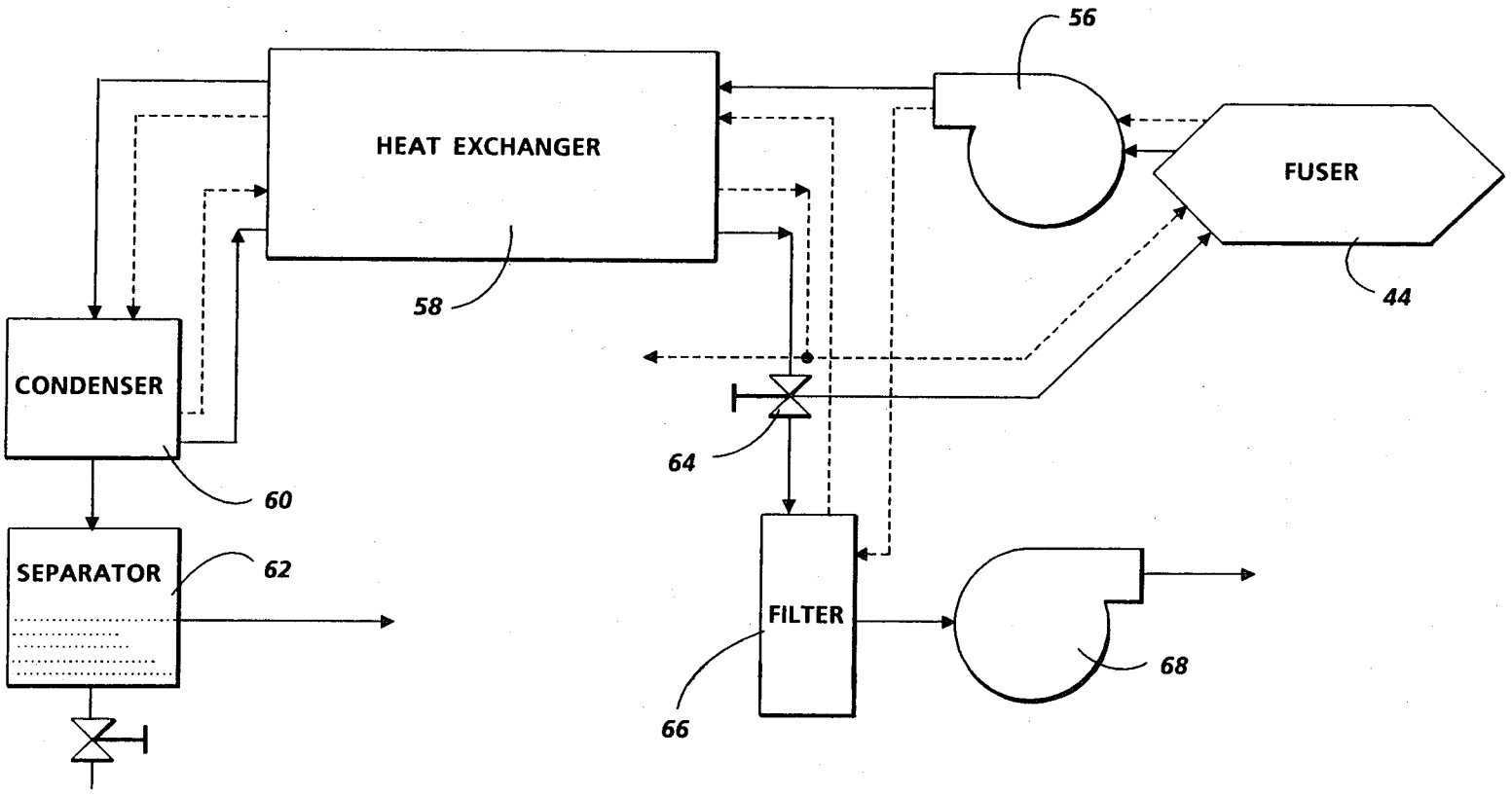

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is an elevational view depicting a recirculating liquid carrier recovery system employed in the FIG. 1 printing machine.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. The photoconductive belt is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into a development tray 28 from which it is drawn through pipe 30 for recirculation. Development electrodes 32, which may be appropriately electrically biased, assist in developing the electrostatic latent image with the toner particles, i.e. the pigmented particles dispersed in the liquid carrier, as it passes in contact with the developing fluid. The charged toner particles, disseminated throughout the liquid carrier, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface charge will be negative and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet through fusing station E.

Fusing station E includes a fuser assembly, indicated generally by the reference numeral 44, which dries the copy sheet and permanently fuses the toner particles in image configuration thereon. As the copy sheet passes through fuser 44, it has both some residual liquid carrier and pigmented particles deposited thereon. A radiant heater generates radiant energy in the infrared wavelength which is selectively absorbed by the developed image areas on the copy sheet. This will cause the liquid carrier in the developed image to vaporize and the pigmented particles to melt, decreasing their viscosity. The radiant heater includes a infrared quartz lamp which is mounted in a reflector assembly in an opposing relationship to the copy sheet and in a position to thermally communicate with the image side thereof. However, one skilled in the art will appreciate that any suitable radiant heater may be employed to heat the developed image as heretofore described. Furthermore, one skilled in the art will appreciate that a oven heater may be used in lieu of a radiant heater to heat the developed image and vaporize the liquid carrier from the copy sheet. After the developed image is heated, either by radiant or oven heating, the copy sheet advances on conveyor belts to catch tray 46 for subsequent removal from the printing machine by the operator. An exhaust system is associated with fuser 44 for sucking the vaporized liquid carrier away from the copy sheet. The vaporized liquid carrier passes through a solvent recovery system which reclaims the liquid carrier and discharges air substantially free from the liquid carrier to the atmosphere. The details of the solvent recovery system will be described hereinafter with reference to FIG. 2.

After the copy sheet is separated from the photoconductive surface of belt 10, some residual liquid developer material remains adhering to belt 10. This residual developer material is moved from the photoconductive surface at cleaning station F. Cleaning station F includes a cleaning roller 48, formed from any appropriate synthetic resin driven in a direction opposite to the direction of movement of the photoconductive surface to scrub the photoconductive surface clean. To assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles dispersed therein. A suitable insulating liquid carrier may be made from a low boiling aliphatic hydrocarbon, such as an Isopar, which is a trademark of the Exxon Corporation. The toner particles are made from a resin which includes a pigment, such as carbon black. By way of example, a suitable liquid developer material is described in U.S. Pat. No. 4,582,774 issued Landa on Apr. 15, 1986, the relevant portions thereof hereby incorporated into the present application.

It is believed that the foregoing description is sufficient for purposes of the present application to illustrate the general operation of an electrophotogrpahic printing machine incorporating the features of the present invention therein.

Referring now to FIG. 2, there is shown the details of the solvent recovery system associated with fuser 44. The solvent recovery system associated with fuser 44 is shown in both the operating mode wherein a sheet of support material is passing through fuser 44 and in the standby mode wherein a sheet of support material is not passing through fuser 44. The operating mode is depicted by solid lines and the standby mode is shown by dashed lines. In the operating mode, the vaporized liquid carrier is exhausted from fuser 44 by blower 56. Blower 56 is coupled to fuser 44 by a suitable conduit. The air and liquid carrier vapors exhausted from fuser 44 are transmitted via a suitable conduit to a heat exchanger 58. By way of example, the air and vaporized liquid carrier enters fuser 44 at a temperature of about 200° C. The air contains from about 1500 parts per million to about 2300 parts per million of the carrier material depending upon the type of carrier being employed. The air flow rate is about 130 acfm. As previously noted, the air and vaporized liquid carrier are conveyed to heat exchanger 58. Heat exchanger 58 is connected via suitable conduits to condenser 60. The air and vaporized liquid carrier exiting heat exchanger 58 are at about 60° C. In condenser 60, the vaporized liquid carrier is condensed and the liquid carrier and water are transmitted to a water/solvent separator 62. The water is discharged from separator 62 and the liquid carrier is returned to tray 28 (FIG. 1) of the development system for subsequent reuse. The cooled air and any residual vaporized liquid carrier is transmitted from condenser 60 back to heat exchanger 58 via a suitable conduit. The cooled air and residual vaporized liquid carrier is at a temperature of about 2° C. The cooled air will have about 158 parts per million to about 965 parts per million of vaporized liquid carrier depending upon the type of material being employed. The cooled air and residual vaporized liquid carrier passing through heat exchanger 58 is heated to about 140° C. as it cools the incoming vaporized liquid carrier from blower 56. The air and residual vaporized liquid carrier exiting from the heat exchanger 58 pass through valve 64. Valve 64 directs approximately 90% of the air and residual vaporized liquid carrier to fuser 48. In this way, heated air is continually entering into fuser 44 to reduce the power required by fuser 44 to heat the copy sheet passing therethrough. Approximately 10% of the air and residual vaporized liquid carrier is directed to filter 66. Filter 66 contains an adsorption material which is activated carbon. Filter 66 traps the residual vaporized liquid carrier and blower 68, which is coupled to filter 66 via a suitable conduit, exhausts the air free from vaporized liquid carrier to the atmosphere. Heat exchanger 58 is coupled by a suitable conduit to valve 64 which, in turn, is coupled by suitable conduits to fuser 44 and filter 66.

In the standby mode, when a sheet of support material is not present at fuser 44, as shown by the dashed lines, the heated air from fuser 44 is exhausted by blower 56 and transmitted by a suitable conduit directly to filter 66. When charged adsorption materials are subjected to heat, the adsorbed substances are liberated and separated from the adsorption material. In this way, the adsorption material may be used again. Thus, the carbon in filter 66 is continually regenerated in the standby mode of operation. The air and released liquid carrier from filter 66 are transmitted through heat exchanger 58 to condenser 60 where the liquid carrier is condensed. Once again, the air, which is now substantially free of gaseous liquid carrier, is transmitted through heat exchanger 58 to cool the incoming air and gaseous liquid carrier. The air exiting from heat exchanger 58 is now heated and passes through valve 64. Valve 64 directs approximately 90% of the heated air to fuser 44 and vents the remaining 10% to the atmosphere.

In recapitulation, it is evident that the solvent recovery system of the present invention provides two modes of operation. In the operative mode, wherein a copy sheet is passing through a fusing device, vaporized liquid carrier is reclaimed and heated air returned to the fuser to minimize the required power output therefrom. In the standby mode, when a copy sheet is not present in the fuser, heated air is transmitted to the filter to regenerate the filter. On the return path, heated air is transmitted to the fuser to once again reduce the power required therefrom. Thus, the fuser air is employed to regenerate the carbon filter and minimize or eliminate the number of filters required during the lifetime of the printing machine. This substantially reduces machine cost and service calls.

It is, therefore, evident that there has been provided in accordance with the present invention, a solvent recovery system that fully satisfies the aims and advantages heretofore mentioned. While this invention has been described in conjunction with a preferred embodiment thereof, it is evident that many alternatives, modifications and variations may be apparent to those skilled in the art. Accordingly, it is intended to embrace all such alternatives, modifications and variations that fall within the spirit and broad scope of the appended claims.

We claim:

1. A reproducing machine of the type having a liquid image comprising at least a liquid carrier having pigmented particles dispersed therein transferred to a sheet of support material, wherein the improvement includes:

means, in the operative mode, for applying heat to the sheet of support material having the liquid image thereon to remove liquid carrier therefrom so as to dry the sheet of support material and fuse the pigmented particles thereto in image configuration, and, in the standby mode when said heat applying means does not apply heat to the sheet of support material, for generating heat;

means for collecting the liquid carrier removed from the sheet of support material by said heat applying means;

means for filtering the air flowing from said collecting means to remove residual liquid carrier therefrom; and means, in the standby mode, for directing heated air from said heat applying means to said filter means to regenerate said filter means.

2. A reproducing machine of the type having a liquid image comprising at least a liquid carrier having pigmented particles dispersed therein transferred to a sheet of support material, wherein the improvement includes:

means, in the operative mode, for applying heat to the sheet of support material having the liquid image thereon to remove liquid carrier therefrom so as to dry the sheet of support material and fuse the pigmented particles thereto in image configuration, and, in the standby mode when said heat applying means does not apply heat to the sheet of support material, for generating heat;

means for collecting the liquid carrier removed from the sheet of support material by said heat applying means;

means for filtering the air flowing from said collecting means to remove residual liquid carrier therefrom;

means, in the standby mode, for directing heated air from said heat applying means to said filter means to regenerate said filter means; and heat exchange means interposed between said heat applying means and said collecting means for receiving the air exiting from said collecting means and said heat applying means to cool the air exiting from said heat applying means and to heat the air exiting from said collecting means with a portion of the heated air from said collecting means exiting from said heat exchange means being directed to said heat applying means and a portion to said filtering means in the operative mode so as to reduce the power required by said heat applying means.

3. A reproducing machine according to claim 2, wherein the portion of the air exiting from said heat exchange means being directed to said filtering means is redirected to the atmosphere in the standby mode.

4. A reproducing machine according to claim 3, wherein said filtering means includes a carbon filter.

5. A reproducing machine according to claim 4, wherein said collecting means includes a condenser.

6. A reproducing machine according to claim 3, further including means, interposed between said heat exchanger means and said filtering means, for controlling the portion of the air flowing from said heat exchanger means to said filtering means and said heat applying means in the operative mode, and the portion of air flowing from said heat exchanger means being vented to the atmosphere and flowing to said heat applying means in the standby mode.

7. An electrophotographic printing machine of the type having an electrostatic latent image recorded on a photoconductive member developed with a liquid developer material comprising at least a liquid carrier having pigmented particles dispersed therein to form a liquid image thereon that is transferred to a sheet of support material, wherein the improvement includes:

means, in the operative mode, for applying heat to the sheet of support material having the liquid image thereon to remove liquid carrier therefrom so as to dry the sheet of support material and fuse the pigmented particles thereto in image configuration, and, in the standby mode when said heat applying means does not apply heat to the sheet of support material, for generating heat;

means for collecting the liquid carrier removed from the sheet of support material by said heat applying means;

means for filtering the air flowing from said collecting means to remove residual liquid carrier therefrom; and means, in the standby mode, for directing heated air from said heat applying means to said filter means to regenerate said filter means.

8. An electrophotographic printing machine of the type having an electrostatic latent image recorded on a photoconductive member developed with a liquid developer material comprising at least a liquid carrier having pigmented particles dispersed therein to form a liquid image thereon that is transferred to a sheet of support material, wherein the improvement includes:

means, in the operative mode, for applying heat to the sheet of support material having the liquid image thereon to remove liquid carrier therefrom so as to dry the sheet of support material and fuse the pigmented particles thereto in image configuration, and, in the standby mode when said heat applying means does not apply heat to the sheet of support material, for generating heat;

means for collecting the liquid carrier removed from the sheet of support material by said heat applying means;

means for filtering the air flowing from said collecting means to remove residual liquid carrier therefrom;

means, in the standby mode, for directing heated air from said heat applying means to said filter means to regenerate said filter means; and heat exchange means interposed between said heat applying means and said collecting means for receiving the air exiting from said collecting means and said heat applying means to cool the air exiting from said heat applying means and to heat the air exiting from said collecting means with a portion of the heated air from said collecting means exiting from said heat exchange means being directed to said heat applying means and a portion to said filtering means in the operative mode so as to reduce the power required by said heat applying means.

9. A reproducing machine according to claim 8, wherein the portion of the air exiting from said heat exchange means being directed to said filtering means is redirected to the atmosphere in the standby mode.

10. A reproducing machine according to claim 9, wherein said filtering means includes a carbon filter.

11. A reproducing machine according to claim 10, wherein said collecting means includes a condenser.

12. A reproducing machine according to claim 9, further including means, interposed between said heat exchanger means and said filtering means, for controlling the portion of the air flowing from said heat exchanger means to said filtering means and said heat applying means in the operative mode, and the portion of air flowing from said heat exchanger means being vented to the atmosphere and flowing to said heat applying means in the standby mode.

* * * * *